US007194880B2

(12) United States Patent
Necchi

(10) Patent No.: US 7,194,880 B2
(45) Date of Patent: Mar. 27, 2007

(54) ANTI-THEFT CASE FOR MISCELLANEOUS ITEMS, PARTICULARLY FOR VIDEOCASSETTES, DVD, COMPACT DISKS, CASSETTES TAPES AND THE LIKE

(76) Inventor: Pietro Necchi, Via Dante 7, I-15013, Borgoratto Alessandrino (IT)

( * ) Notice: Subject to any disclaimer, the term of this patent is extended or adjusted under 35 U.S.C. 154(b) by 0 days.

(21) Appl. No.: 10/530,648

(22) PCT Filed: Oct. 11, 2002

(86) PCT No.: PCT/IT02/00650

§ 371 (c)(1),
(2), (4) Date: Apr. 6, 2005

(87) PCT Pub. No.: WO2004/033830

PCT Pub. Date: Apr. 22, 2004

(65) Prior Publication Data

US 2006/0005587 A1 Jan. 12, 2006

(51) Int. Cl.
*E05B 65/00* (2006.01)

(52) U.S. Cl. ..... 70/57.1; 70/63; 206/1.5; 206/308.2; 206/387.11

(58) Field of Classification Search ..... 70/57.1, 70/63, 58, 276, 159–162; 206/1.5, 308.2, 206/387.11, 251.5, 146, 147, 150
See application file for complete search history.

(56) References Cited

U.S. PATENT DOCUMENTS 1,561,018 A * 11/1925 Peelle ..... 292/177
1,878,413 A * 9/1932 Leberman ..... 292/145
1,883,481 A * 10/1932 Baum ..... 292/207
2,286,427 A * 6/1942 Levensten ..... 312/222
2,570,341 A * 10/1951 Hake ..... 220/840
3,837,692 A * 9/1974 Ayers et al. ..... 292/152
3,933,381 A * 1/1976 Schurman ..... 292/57
3,994,416 A 11/1976 Mulligan
4,453,743 A 6/1984 Sanders et al.
4,469,225 A * 9/1984 Takahashi ..... 206/387.1
4,966,020 A * 10/1990 Fotheringham et al. ..... 70/276
5,598,728 A 2/1997 Lax
5,760,689 A 6/1998 Holmgren
6,374,648 B1 * 4/2002 Mitsuyama ..... 70/57.1
6,497,125 B1 * 12/2002 Necchi ..... 70/57.1
6,516,639 B1 * 2/2003 Margetts et al. ..... 70/57.1
2002/0023853 A1 * 2/2002 Lax et al. ..... 206/310

FOREIGN PATENT DOCUMENTS

FR 2 460 855 A 1/1981

* cited by examiner

*Primary Examiner*—Lloyd A. Gall
(74) *Attorney, Agent, or Firm*—David A. Farah; Sheldon Mak Rose & Anderson PC

(57) ABSTRACT

An anti-theft case (1) is disclosed, particularly for videocassettes, DVD, compact disks, cassette tapes, comprising: first and second mutually hinged half-cases (3, 5); a separate opening and closing member (12) and a locking and unlocking member (18) of the case. In order to optimize assembling and costs of the case (1), the two half-cases (3, 5) are of a same shape and size; the opening and closing member (12) is shaped as an elongated slider and is inserted into a seat (20', 20") obtained in the half-cases (3, 5); and the locking and unlocking member (18) is composed of a cylindrical pin adapted to go in and out of a seat (22) obtained in the opening and closing member (12).

6 Claims, 4 Drawing Sheets

ANTI-THEFT CASE FOR MISCELLANEOUS ITEMS, PARTICULARLY FOR VIDEOCASSETTES, DVD, COMPACT DISKS, CASSETTES TAPES AND THE LIKE

CROSS-REFERENCE TO RELATED APPLICATION

The present application is a U.S. National Phase Application of International Application PCT/IT2002/000650, titled "Anti-theft Case for Miscellaneous Items, Particularly for Videocassettes, DVD, Compact Disks, Musicassettes and the like," filed Oct. 11, 2002, the contents of which are incorporated herein in its entirety.

FIELD

The present invention refers to an anti-theft case for miscellaneous items, particularly for videocassettes, DVD, compact disks, cassette tapes and the like, but also for software, printer cartridges, perfumes and similar items.

BACKGROUND

Anti-theft cases of the above-mentioned type are known in the art. They have different configurations and shapes adapted for the object that they must contain, preventing its theft from the places where the objects are exhibited, through transmitter means contained in the cases themselves and that are adapted to trigger suitable receiver means placed near the exits of the exhibition places.

In particular, one of the known configurations provides for a box-shaped case made of two parts that are mutually-hinged on one side and locked when opening and closing by various types of opening and closing means and locking and unlocking means, usually placed on the opposite side with respect to the one where the hinges are located.

These cases however are not satisfactory and have some problems: first of all, the two case parts are of a mutually different shape and therefore require realising two different dies, with high cost increases; moreover, they are scarcely flexible, requiring particular designs, always mutually different, according to the objects that they will have to contain; finally, the opening and closing means and the locking and unlocking means are of a mechanical or magnetic type, and are complex and costly to make, being equipped with a relatively high number of component parts.

SUMMARY OF THE INVENTION

Object of the present invention is solving the above prior-art problems, by providing an anti-theft case that is simple to make, being composed of two mutually identical parts, that can be assembled easily and with a reduced cost.

A further object of the present invention is providing a case of the above mentioned type that is equipped with opening and closing means in a single piece and equipped with locking and unlocking means that are simple and in a reduced number, further contributing to decrease the case cost, without impairing its final efficiency.

The above and other objects and advantages of the invention, as will appear from the following description, are obtained by an anti-theft case as claimed in Claim 1. Preferred embodiments and non-trivial variations of the present invention are claimed in the dependent Claims.

DRAWINGS

The present invention will be better described by some preferred embodiments thereof, given as a non-limiting example, with reference to the enclosed drawings, in which.

DESCRIPTION

Figure 1:
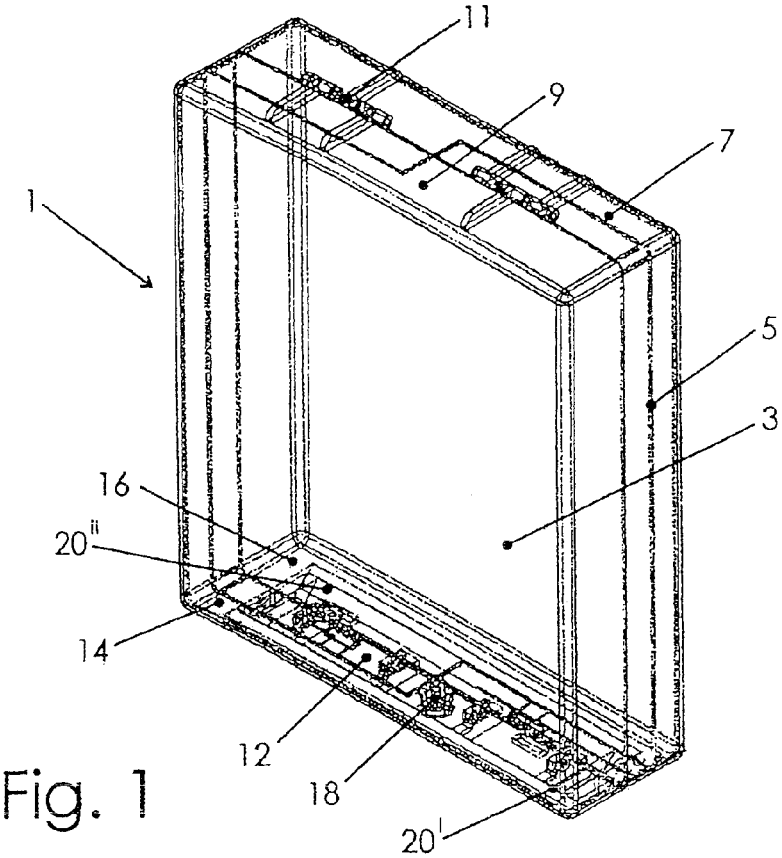
FIG. 1 is a perspective view of an embodiment of the anti-theft case according to the present invention.
Figure 2:
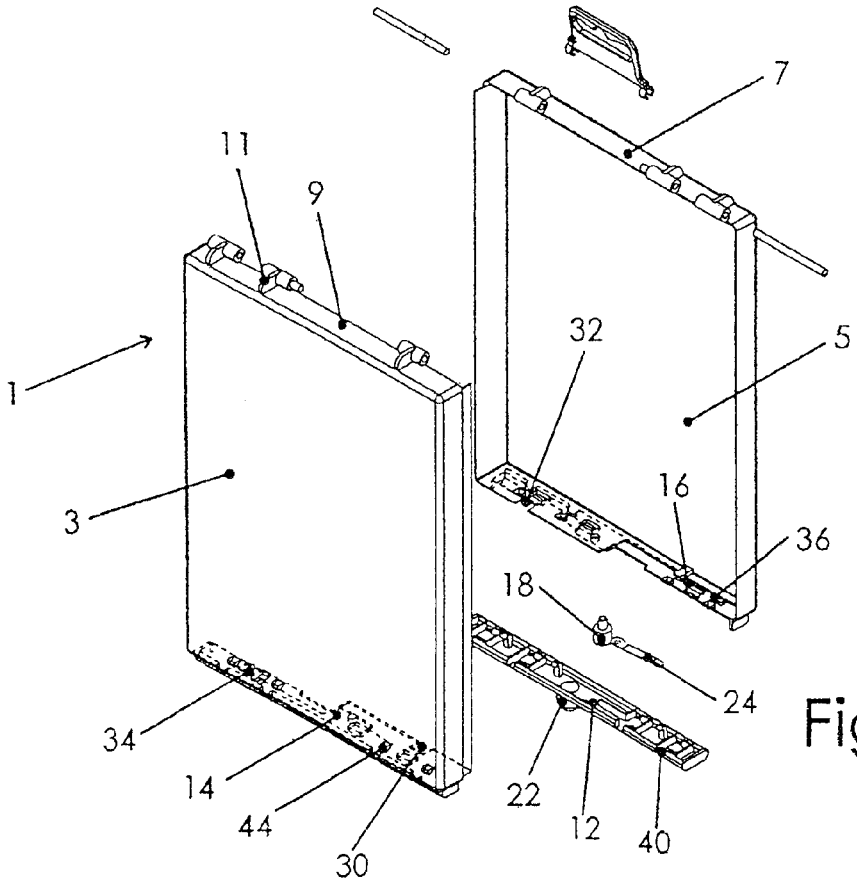
FIG. 2 is an exploded perspective view of the case of FIG. 1, that shows its main component parts.
Figure 3:
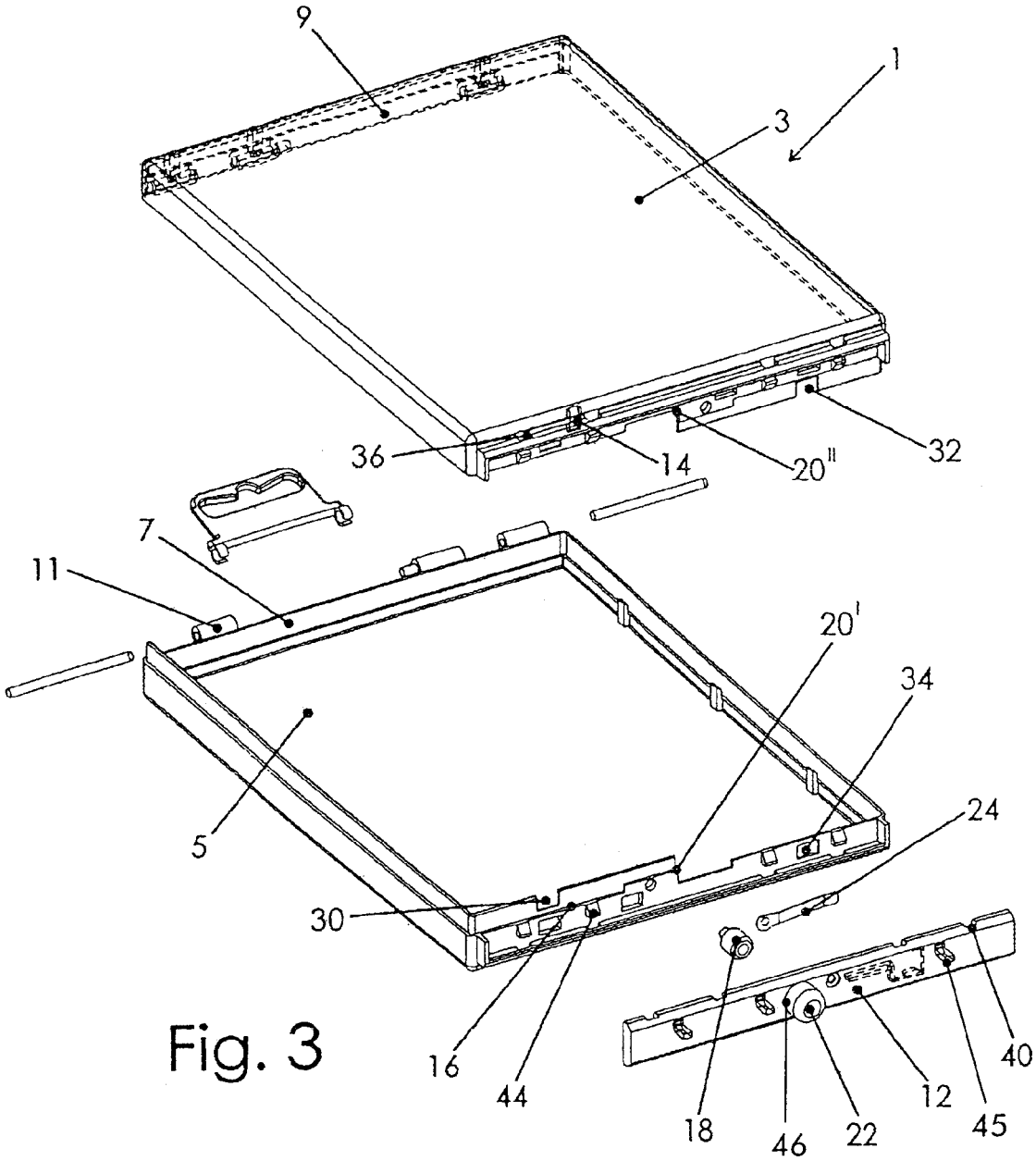
FIG. 3 is another exploded perspective view similar to FIG. 2 and made from another angle.
Figure 4:
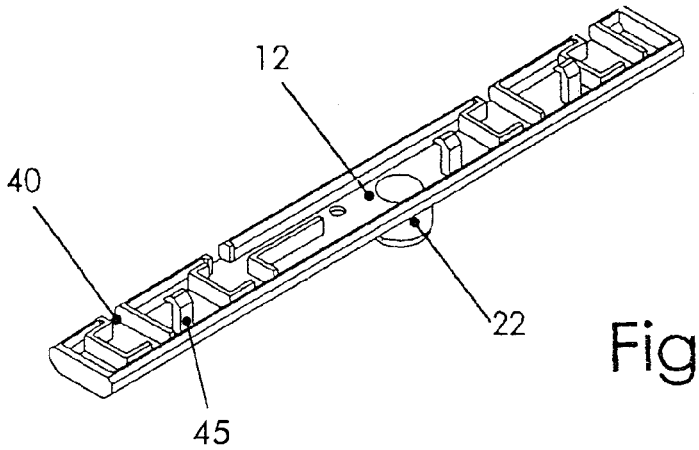
FIG. 4 is a detailed perspective view of the opening and closing means.
Figure 5:
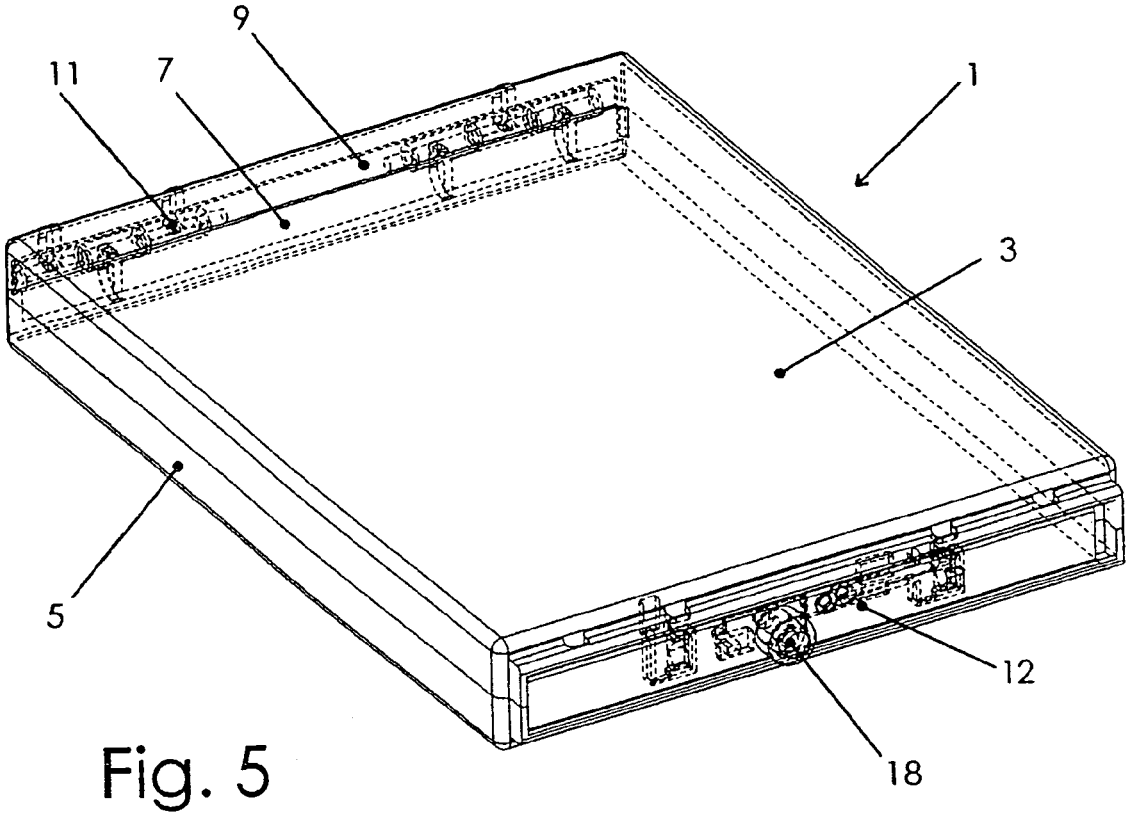
FIGS. 5 to 8 are views that show four opening/closing steps of the case of the present invention.

With reference to the Figures, a preferred embodiment of the anti-theft case of the present invention is shown and described. It will be readily obvious that numerous variations and modifications (for example related to shape, sizes, various colours and parts with equivalent functionalities) can be made to the described case without departing from the scope of the invention as appears in the enclosed Claims.

The Figures shows a preferred embodiment of the anti-theft case 1 of the present invention, particularly adapted for containing videocassettes, DVD, compact disks, cassette tapes and the like. Such anti-theft case 1 comprises:

- a first half-case 3;
- a second half-case 5 hinged on one side 7 to a corresponding side 9 of the first half-case 3 through common hinge means 11;
- opening and closing means 12 placed in order to engage one side 14 of the first half-case 3 opposite to the side 9 and one side 16 of the second half-case 5 opposite to the side 7 in order to allow opening and closing the anti-theft case 1; and
- locking and unlocking means 18 adapted to lock and unlock the opening and closing means 12 in their operating positions.

The anti-theft case 1 of the present invention, in order to obtain the above-mentioned objects, first of all provides for the fact that the first half-case 3 and the second half-case 5 are of the same shape and size: this allows using a single die for manufacturing the case 1 and readily adapting such case 1 to any type of product that it will have to contain.

Moreover, as a further improving feature of the case 1 of the invention, the opening and closing means 12 are shaped as an elongated slider (preferably with a trapezoidal transverse section) and are inserted into a seat 20', 20" obtained in the first and second half-cases 3, 5.

Still more, the locking and unlocking means 18 are composed of a cylindrical pin adapted to go in and out of a seat 22 obtained in the opening and closing means 12, and they can be equipped with holding hooks 45 to further improve the case 1 closure.

A compact anti-theft case 1 is thereby realised, composed of a very small number of component parts, with a reduced cost and that can be easily manufactured and assembled, and that is at the same time compact and sturdy, for the end use provided therefor.

As operating variation, the case 1 of the invention can further be equipped with resilient means 24 (commonly an elongated plane lamellar spring or an helical spring) opera tively connected to one of the first or second half-cases 3, 5 and to the opening and closing means 12: such resilient means 24 are adapted to push the opening and closing means 12 in an opening position when they are unlocked by the locking and unlocking means 18.

In order to improve the operating closing seal, the anti-theft case 1 of the invention can provide for the fact that the first and second half-cases 3, 5 are equipped, on the side where the opening and closing means 12 operate, with at least one groove 30, 32 adapted to engage a corresponding pin 34, 36 of the opposite half-case.

Moreover, the opening and closing means 12 are equipped with a plurality of recesses 40 adapted to engage corresponding projections 44 of the first and second half-cases 3, 5 in order to realise a closing of the anti-theft case 1.

Finally, the seat 22 of the opening and closing means 12 is equipped with walls 46 for enabling a sliding of the locking and unlocking means 18 and with at least one holding shoulder for unmovably holding the locking and unlocking means 18 in a closing position.

The operation of the anti-theft case 1 according to the present invention will now be described, with reference to FIG. 5 to 8.

Figure 6:
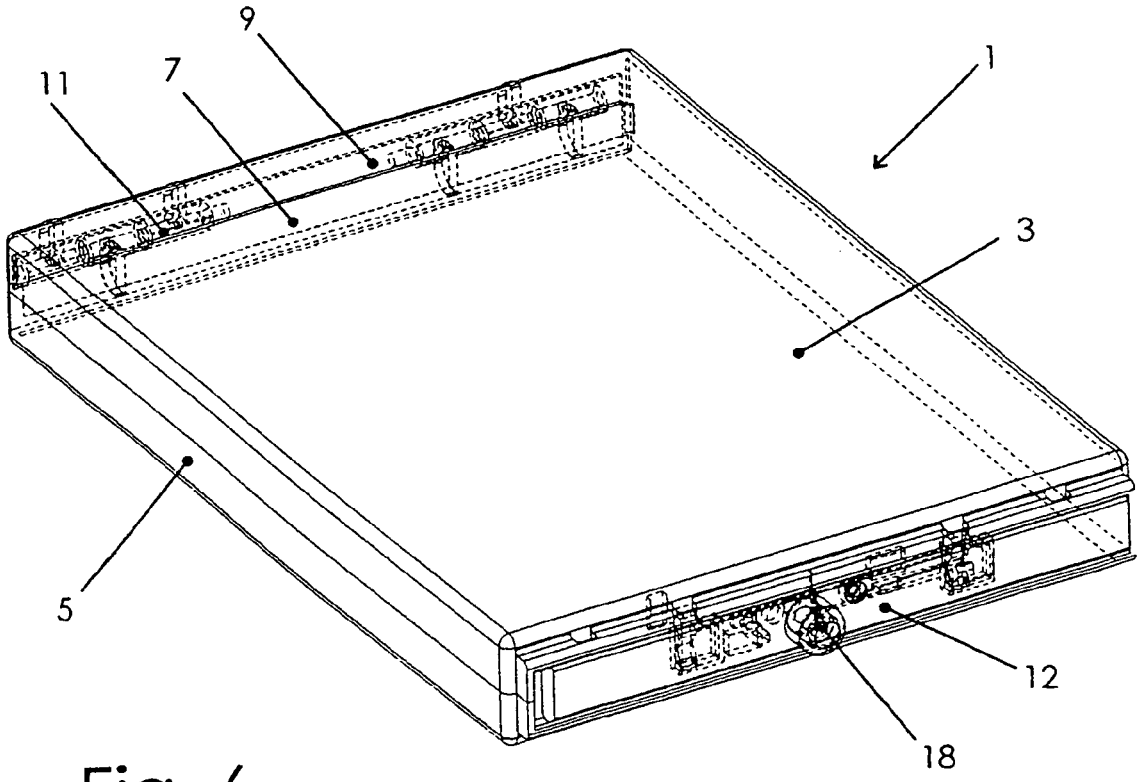
Figure 7:
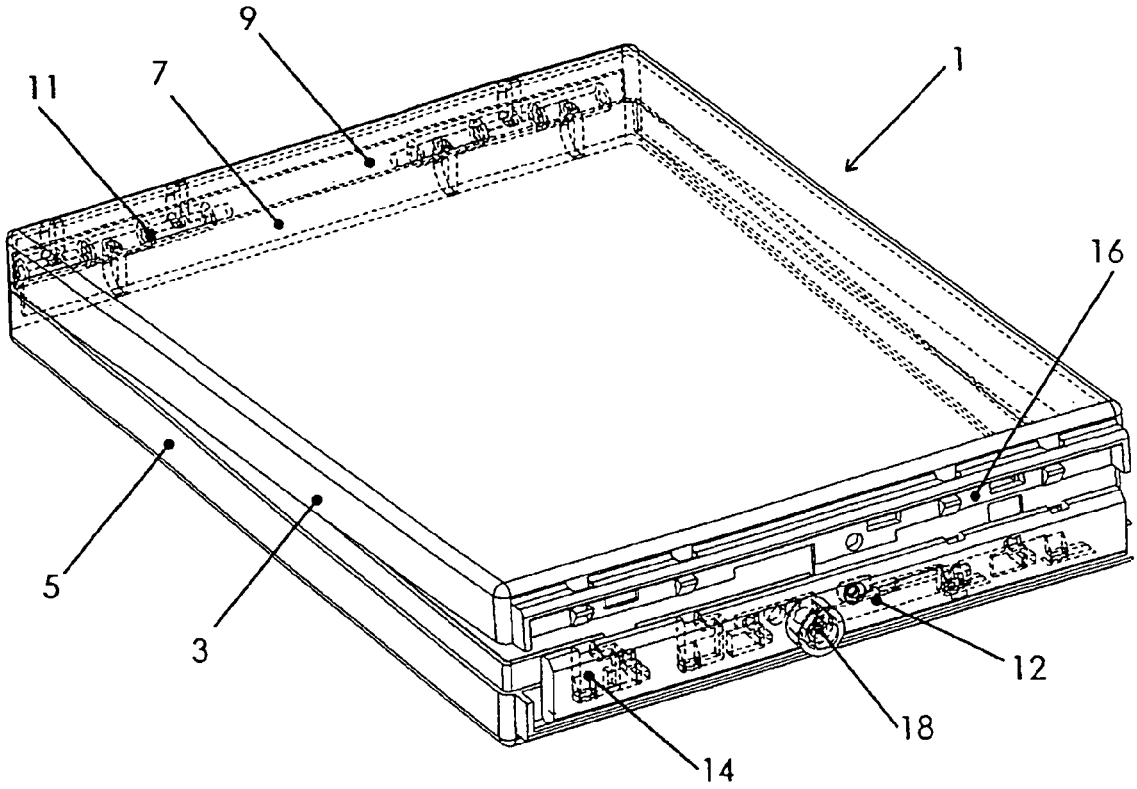
Figure 8:
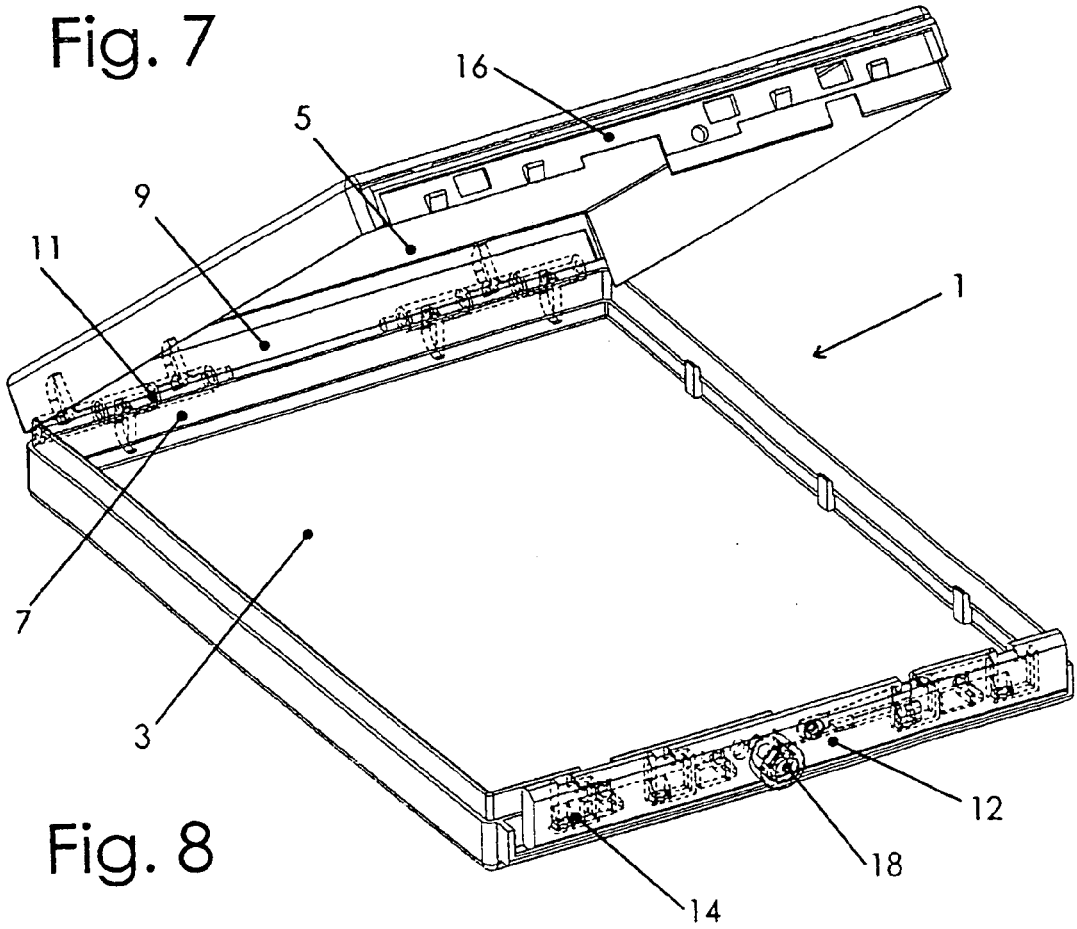

With the open case 1 (FIG. 8), in order to close it, the object to be protected is placed into the case 1 and the two half-cases 3, 5 are closed one over the other (FIG. 6 and 7) making the opening and closing means 12 slide til the locking and unlocking means 18 have slid into the seat 22 abutting onto the holding shoulder in order to lock the case 1 in a closing position (FIG. 6).

In order to open the case 1, the locking and unlocking means 18 are attracted (through known magnetic means, commonly available in the sales counters of the places where the cases 1 are located) toward the shoulder of the seat 22, freeing thereby the opening and closing means 12, that are slid (manually or through the resilient means 24) into their disengagement position with the first and second half-cases 3, 5 in order to allow opening the case 1 for removing therefrom or inserting therein a product.

Although the present invention has been discussed in considerable detail with reference to certain preferred embodiments, other embodiments are possible. Therefore, the scope of the appended claims should not be limited to the description of preferred embodiments contained in this disclosure. All references cited herein are incorporated by reference to their entirety.

The invention claimed is:

1. An anti-theft case for miscellaneous items, particularly for videocassettes, DVD, compact disks, cassette tapes and the like, comprising:

a first half-case;

a second half-case hinged on a first side to a corresponding first side of said first half case through hinge means;

opening and closing means separate from the first half-case, and from the second half-case placed in order to engage a second side of said first half-case opposite to said first side of said first half-case and a second side of said second half case opposite to said first side of said second half case in order to allow opening and closing said anti-theft case; and locking and unlocking means adapted to lock and unlock said opening and closing means in their operating positions;

wherein:

said first half case has a shape and a size that are identical to a corresponding shape and size of said second half-case;

said opening and closing means are shaped as an elongated slider and are inserted into a seat obtained in said first and second half-cases; and said locking and unlocking means are composed of a cylindrical pin adapted to go in and out of a seat obtained in said opening and closing means.

2. The anti-theft case according to claim 1, wherein said anti-theft case is further equipped with resilient means operatively connected to one of said first or second half-cases and to said opening and closing means, said resilient means being adapted to push said opening and closing means in an opening position when they are unlocked by said locking and unlocking means.

3. The anti-theft case according to claim 2, wherein said resilient means are composed of an elongated plane lamellar spring.

4. The anti-theft case according to claim 1, wherein said first and second half-cases are equipped, on the side where said opening and closing means operate, with at least one groove adapted to engage a corresponding pin of the opposite half-case in order to guarantee a better closing seal of said anti-theft case.

5. The anti-theft case according to claim 1, wherein said opening and closing means are equipped with a plurality of recesses adapted to engage corresponding projections of said first and second half-cases in order to realize a closing of said anti-theft case, and with holding hooks.

6. The anti-theft case according to claim 1, wherein the seat of said opening and closing means is equipped with walls for enabling a sliding of said locking and unlocking means.

* * * * *